US007385502B2

(12) United States Patent
Deola

(10) Patent No.: US 7,385,502 B2
(45) Date of Patent: Jun. 10, 2008

(54) LOCATOR BEACON

(76) Inventor: Richard L. Deola, 115 N. Second St., Vineland, NJ (US) 08360

( * ) Notice: Subject to any disclaimer, the term of this patent is extended or adjusted under 35 U.S.C. 154(b) by 187 days.

(21) Appl. No.: 11/418,283

(22) Filed: May 4, 2006

(65) Prior Publication Data

US 2007/0257793 A1 Nov. 8, 2007

(51) Int. Cl.
*G08B 1/08* (2006.01)
*G01D 21/00* (2006.01)

(52) U.S. Cl. ..... 340/539.21; 340/384.1; 340/815.4; 33/286; 33/613

(58) Field of Classification Search ..... 340/539.21
See application file for complete search history.

(56) References Cited

U.S. PATENT DOCUMENTS 4,096,438 A 6/1978 Humphrey
5,298,987 A 3/1994 Tomita
5,432,434 A 7/1995 Tugwell
5,509,213 A 4/1996 Kelly et al.
6,000,142 A 12/1999 Deaton
6,470,579 B2 * 10/2002 Allen ..... 33/286
6,957,797 B1 10/2005 Strobel
7,073,268 B1 * 7/2006 Etter et al. ..... 33/286
7,178,250 B2 * 2/2007 Nash et al. ..... 33/286
7,310,887 B2 * 12/2007 Nash et al. ..... 33/286
2005/0102063 A1 * 5/2005 Bierre ..... 700/247
2007/0044331 A1 * 3/2007 Yung et al. ..... 33/286

* cited by examiner

*Primary Examiner*—George Bugg

(57) ABSTRACT

A locator system includes a transmitter unit that is located on one side of a wall or barrier and generates a locator signal when activated and a receiver unit element that is located on the other side of the wall or barrier and is activated by the locator signal to indicate the exact and precise location at which the work is to be done.

3 Claims, 1 Drawing Sheet

LOCATOR BEACON

TECHNICAL FIELD OF THE INVENTION

The present invention relates to the general art of construction, and to the particular field of tools and accessories used in construction.

BACKGROUND OF THE INVENTION

It has been customary for persons wishing to hang an item, such as a picture, mirror, door or other such object on a wall, to hold an item, such as a picture frame in the desired mounting position, and attempt, with a finger, pencil, or other object, to locate and mark the correct location for installation of the hanging hardware. This method is highly imprecise, and can be very awkward. With methods known to the inventor, the user can only mark the approximate location where the item should be placed. The pencil method has an additional disadvantage in that it makes disfiguring marks on the wall, often covering areas far removed from the actual hanger site, and sometimes, including random marks that are accidentally placed on the wall, when the pencil is inserted or removed. The finger method also has major disadvantages. Methods and devices used to hang pictures are generally not applicable to locating the position in a wall at which a doorway or other opening is to be defined, or locating the position in a floor at which an opening is to be defined.

Accordingly, hanging items such as pictures, mirrors, doors and other wall hangings has traditionally been an imprecise, awkward and frustrating procedure for most people, particularly when the elements supporting the item are concealed when the item is hung. When multiple people are involved or multiple items are to be hung in precise alignment to each other, the difficulty and frustration increases.

Since the result of the methods known to the inventor is the marking of the approximate location where the nail, or similar hardware, should be secured to the wall, frequently the person hanging the item has to reposition the nail or other hardware or elements associated with the item being hung, sometimes more than once, in order to get the desired result. This repositioning generally results in multiple disfiguring marks or holes on the wall, either from the pencil, the hanging hardware, or both. Some of these marks may be visible once the item is positioned. The disfiguring marks then may require repair, possibly including touch-up paint.

Most known picture hanging aids are directed to locating a position for a single hanger on a wall. Such devices are not useful for hanging large, heavy objects requiring use of two or more hangers to be securely hung. Nor are they useful in locating the position for a door or the like which will require a hole to be defined through a wall or through a floor. Devices directed to locating two picture hangers generally are complex and do not allow simple alignment of all types of hangers on a wall.

Therefore, there is a need for a simple device and method for locating and aligning one or more hangers of any type on a wall. There is a further need for a means and method for locating where a hole should be defined through a wall or a floor.

SUMMARY OF THE INVENTION

The above-discussed disadvantages of the prior art are overcome by a locator device that includes a first element that is located on one side of a wall or barrier and generates a locator signal when activated and a second element that is located on the other side of the wall or barrier and is activated by the locator signal to indicate the exact and precise location at which the work is to be done.

Using the work locator system embodying the present invention will permit a user to precisely and exactly identify the exact and precise location at which work is to be carried out on a building element, such as a wall, a floor or the like. One person can easily carry out the locating process even if the process involves multiple rooms or multiple objects.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

FIG. 3 shows the transmitter element mounted on one side of a wall at a desired location at which work is to be carried out on the wall on or from the other side of the wall and a receiver element located on the side of the wall which is to be worked on.

DETAILED DESCRIPTION OF THE INVENTION

Figure 2:
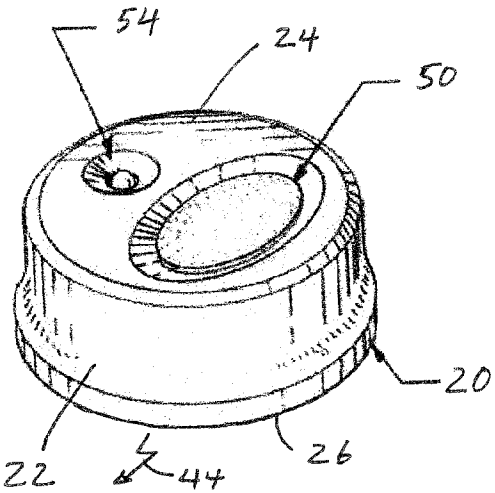
FIG. 2 is a perspective view of a transmitter element included in the system embodying the present invention.
Figure 3:
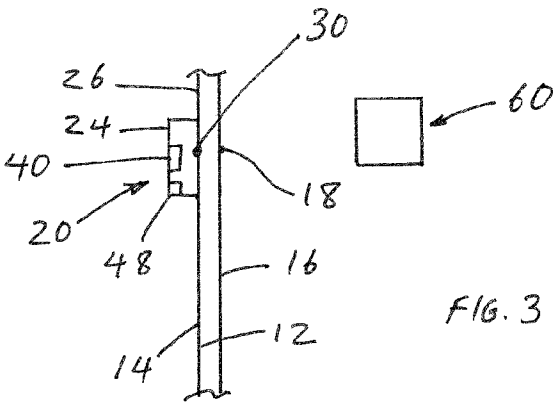
Figure 1:
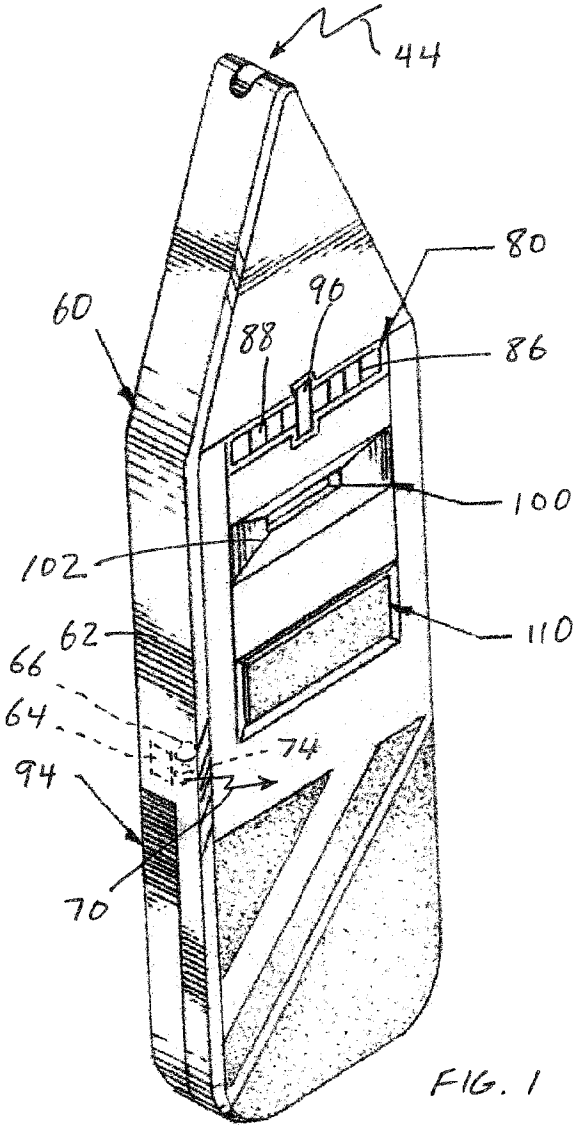
FIG. 1 is a perspective view of a receiver element included in the system embodying the present invention.

Referring to the figures, it can be understood that the present invention is embodied in a work location locator system which can be used to precisely identify a target the location. The locator system of the present invention comprises a building barrier 12, such as a wall, having a first side 14 and a second side 16. A target location 18 is located on second side 16. For example, a hole must be drilled in the wall at the target location to hang a heavy object or the like. In some instances, it is easier to locate the target location from the opposite of the wall than it is to measure and locate the target location on the side of the wall on which it is to be located. The system embodying the present location will assist this process.

The system of the present invention comprises a transmitter unit 20 which includes a housing 22 having a first side 24 which is an exposed side when the housing is placed on first side 14 of the barrier and a second side 26 which is an underside when the housing is placed on the first side of the barrier. Mounting elements 30 on the housing releasably attach the housing of the transmitter unit to the first side of the barrier. The mounting elements can be suction cups or the like.

A transmitter circuit unit 40 is located in housing 22 and generates a locator signal 44 through second side 26 of housing 20. Signal 44 passes through the barrier when unit 40 is activated. A power unit 48 is located in the housing, and can include a battery or the like. An on/off switch 50 is located on housing 20 and electrically connects the power unit to the transmitter unit when in the "on" position to generate locator signal 44. A signal light 54 is electrically connected to the transmitter unit to be activated when the transmitter unit is activated.

The system further comprises a hand-held receiver unit 60 which includes a housing 62. A signal sensor unit 64 is located in housing 62. Signal sensor unit 64 includes circuitry 66 which generates an electric signal 70 when a locator signal is received by the signal sensor unit. Circuitry 66 in the signal sensor unit includes circuitry 74 which changes signal strength of the electric signal according to the location of the receiver unit with respect to the transmitter unit. The signal strength of the electric signal being greater when the receiver unit is close to the transmitter unit than when the receiver unit is farther away from the receiver unit whereby the signal strength of the electric signal increases as the receiver unit is moved closer to the transmitter unit.

An indicator light system 80 is located on housing 62. Indicator light system 80 is electrically connected to signal sensor unit 64 to be activated by electric signal 70 generated by the signal sensor unit. Indicator light system 80 includes circuitry 82 which increases the intensity of the light associated with the indicator light system as the signal strength of the electric signal increases. Indicator light system 80 further includes a light bar 86 containing a plurality of light elements, such as LED 88, with more elements being activated as the receiver unit moves closer to the transmitter unit. A central light 90 can also be activated when the strength of signal 44 is strongest for the receiver.

A power source 94, such as a battery or the like, is located in the housing of the receiver unit. A speaker unit 100 is located on housing 62 of the receiver unit. Speaker unit 100 is electrically connected to signal sensor unit 64 to be activated by electric signal 70 generated by the signal sensor unit to generate an audible signal in response to the electric signal generated by the signal sensor unit. Speaker unit 100 includes circuitry 102 which increases the intensity of the audible signal associated with the speaker unit as the signal strength of the electric signal increases.

An on/off switch 110 is located on housing 62 of the receiver unit and electrically connects power source 94 in the housing of the receiver unit to signal sensor unit 64 and to the indicator light system 80 and to the speaker unit 100 when the on/off switch is in an "on" position. The circuitry of the transmitter and receiver units is known to those skilled in the art. The exact details of those circuits are known and are not important to this invention. As such, the details of the circuits will not be claimed or disclosed.

Use of locator system 10 can be understood from the teaching of the foregoing disclosure and thus will only be briefly discussed. A target location 30 is selected on barrier 12, and the transmitter is placed on the barrier at the target location. The transmitter is releasably mounted on the barrier. The receiver unit is taken by a worker to the other side of the barrier and is activated to receive signal 44 from the transmitter unit. The visible and audible signals generated by the receiver unit change strength as the receiver unit moves toward or away from the transmitter unit, and these signals are used to locate target location 18 which corresponds to target location 30 associated with the transmitter. In this manner, the location on one side of the barrier that corresponds to the target location on the other side of the barrier can be quickly and accurately identified.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A work location locator system comprising:

A) a building barrier, such as a wall, having a first side and a second side;

B) a transmitter unit which includes (1) a housing having a first side which is an exposed side when the housing is placed on the first side of the barrier, and a second side which is an underside when the housing is placed on the first side of the barrier, (2) mounting elements on the housing for releasably attaching the housing of the transmitter unit to the first side of the barrier, (3) a transmitter circuit unit in the housing which generates a locator signal through the second side of the housing of the transmitter unit and through the barrier when activated, (4) a power unit in the housing, (5) an on/off switch on the housing of the transmitter unit which electrically connects the power unit to the transmitter unit when in the "on" position to generate the locator signal, and (6) a signal light electrically connected to the transmitter unit to be activated when the transmitter unit is activated; and C) a receiver unit which includes (1) a housing, (2) a signal sensor unit in the housing of the receiver unit, the signal sensor unit including circuitry which generates an electric signal when a locator signal is received by the signal sensor unit, the circuitry in the signal sensor unit including circuitry which changes signal strength of the electric signal according to the location of the receiver unit with respect to the transmitter unit, the signal strength of the electric signal being greater when the receiver unit is close to the transmitter unit than when the receiver unit is farther away from the receiver unit whereby the signal strength of the electric signal increases as the receiver unit is moved closer to the transmitter unit, (3) an indicator light system on the housing of the receiver unit, the indicator light system being electrically connected to the signal sensor unit to be activated by the electric signal generated by the signal sensor unit, the indicator light system including circuitry which increases the intensity of the light associated with the indicator light system as the signal strength of the electric signal increases, (4) a power source in the housing of the receiver unit, (5) a speaker unit on the housing of the receiver unit, the speaker unit being electrically connected to the signal sensor unit to be activated by the electric signal generated by the signal sensor unit to generate an audible signal in response to the electric signal generated by the signal sensor unit, the speaker unit including circuitry which increases the intensity of the audible signal associated with the speaker unit as the signal strength of the electric signal increases, and (6) an on/off switch on the housing of the receiver unit which electrically connects the power source in the housing of the receiver unit to the signal sensor unit and to the indicator light system and to the speaker unit when the on/off switch is in an "on" position.

2. The work location locator system defined in claim 1 wherein the indicator light system of the receiver unit includes a light bar containing a plurality of light elements.

3. A work location locator system comprising:

A) a building barrier, such as a wall, having a first side and a second side;

B) a transmitter unit which includes a transmitter circuit unit in the housing which generates a locator signal through the second side of the housing of the transmitter unit and through the barrier when activated; and C) a receiver unit which includes (1) a signal sensor unit which includes circuitry which generates an electric signal when a locator signal is received by the signal sensor unit, the circuitry in the signal sensor unit including circuitry which changes signal strength of the electric signal according to the location of the receiver unit with respect to the transmitter unit, the signal strength of the electric signal being greater when the receiver unit is close to the transmitter unit than when the receiver unit is farther away from the receiver unit whereby the signal strength of the electric signal increases as the receiver unit is moved closer to the transmitter unit, (2) an indicator light system on the housing of the receiver unit, the indicator light system being electrically connected to the signal sensor unit to be activated by the electric signal generated by the signal sensor unit, the indicator light system including circuitry which increases the intensity of the light associated with the indicator light system as the signal strength of the electric signal increases, and (3) a speaker unit on the housing of the receiver unit, the speaker unit being electrically connected to the signal sensor unit to be activated by the electric signal generated by the signal sensor unit to generate an audible signal in response to the electric signal generated by the signal sensor unit, the speaker unit including circuitry which increases the intensity of the audible signal associated with the speaker unit as the signal strength of the electric signal increases.

* * * * *